United States Patent [19]

Ignatjev

[11] 4,284,269

[45] Aug. 18, 1981

[54] DOCUMENT FEEDER FOR DOCUMENT-HANDLING MACHINE

[75] Inventor: Vladimir Ignatjev, Norwalk, Conn.

[73] Assignee: Burroughs Corporation, Detroit, Mich.

[21] Appl. No.: 52,501

[22] Filed: Jun. 27, 1979

[51] Int. Cl.[3] ..... B65H 3/52

[52] U.S. Cl. ..... 271/122; 271/165; 271/171

[58] Field of Search ..... 271/122, 121, 124, 165, 271/171, 37, 38, 119, 120, 115, 160

[56] References Cited

U.S. PATENT DOCUMENTS

| | | | |
|---|---|---|---|
| 749,986 | 1/1904 | Dick | 271/122 |
| 798,857 | 9/1905 | Zander | 271/119 |
| 813,810 | 2/1906 | Maynard | 271/122 |
| 2,836,416 | 5/1958 | Van Marle | 271/122 |
| 3,220,605 | 11/1965 | Casey | 271/119 UX |
| 3,857,559 | 12/1974 | McInerny | 271/122 |
| 3,869,117 | 3/1975 | Yoshimura | 271/35 X |
| 3,933,350 | 1/1976 | Mignano | 271/37 X |
| 3,937,455 | 2/1976 | Hauser | 271/122 X |
| 4,114,870 | 9/1978 | DiBlasio | 271/122 X |

*Primary Examiner*—Bruce H. Stoner, Jr.

*Attorney, Agent, or Firm*—Kevin R. Peterson; Robert A. Green; Edward J. Feeney, Jr.

[57] ABSTRACT

The disclosure is of apparatus for supporting a stack of documents and feeding the documents, one at a time, from the bottom of the stack to an operating position in a document processing machine.

10 Claims, 8 Drawing Figures

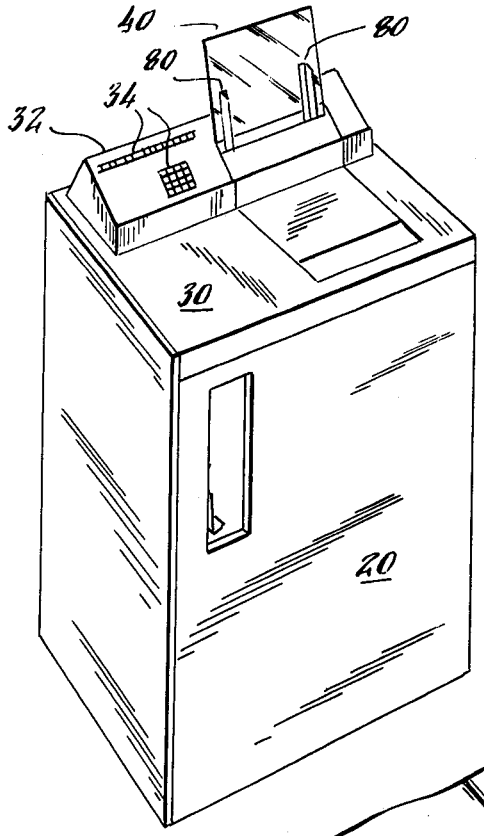
Fig. 1.
Fig. 2.
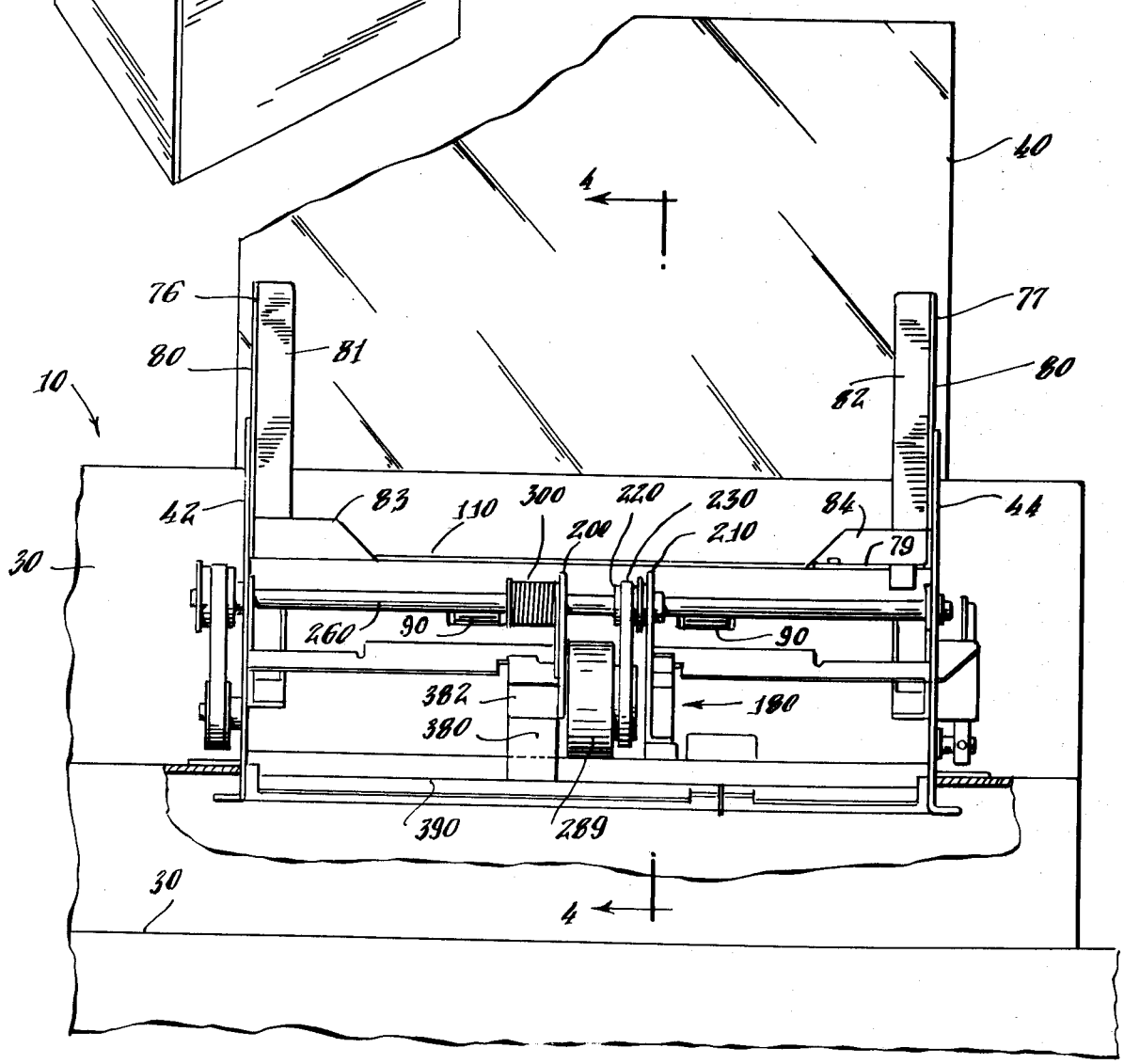

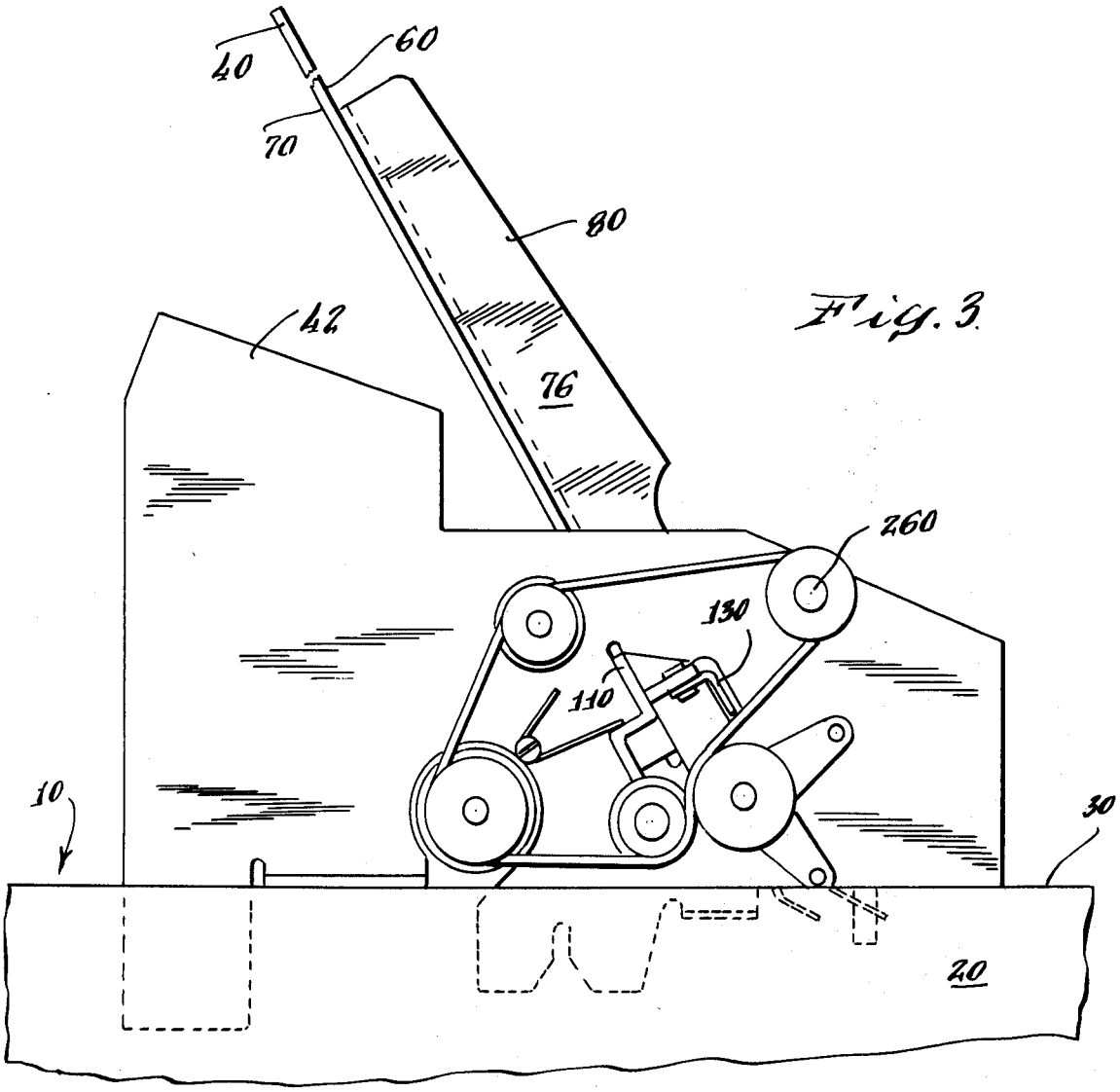
Fig. 3.
Fig. 8.
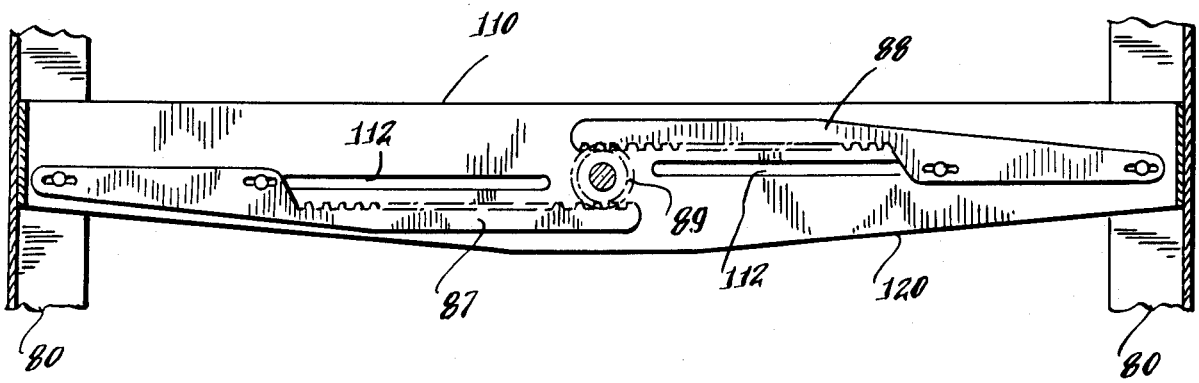

DOCUMENT FEEDER FOR DOCUMENT-HANDLING MACHINE

BACKGROUND OF THE INVENTION

There are many types of document-handing machines, such as facsimile machines, available commercially. These machines handle stacks of documents, from which one document at a time is fed into the machine for processing. Most commonly, the documents are fed one at a time from the top of the stack; however, the present invention permits the feeding of documents, one at a time, from the bottom of the stack, and this permits documents to be added to a stack while the machine is operating, without disturbing the operation. Those presently known machines which permit feeding from the bottom of a stack of documents have separate feeding and separating stations which the machine of the invention does not have.

DESCRIPTION OF THE DRAWINGS

FIG. 1 is a perspective view of a facsimile machine embodying the invention;

FIG. 2 is a front elevational view of a portion of the machine of FIG. 1;

FIG. 3 is a side elevational view of the apparatus shown in FIG. 2;

FIG. 8 is a bottom view of the apparatus of FIG. 6.

DESCRIPTION OF THE PREFERRED EMBODIMENTS

Figure 4:
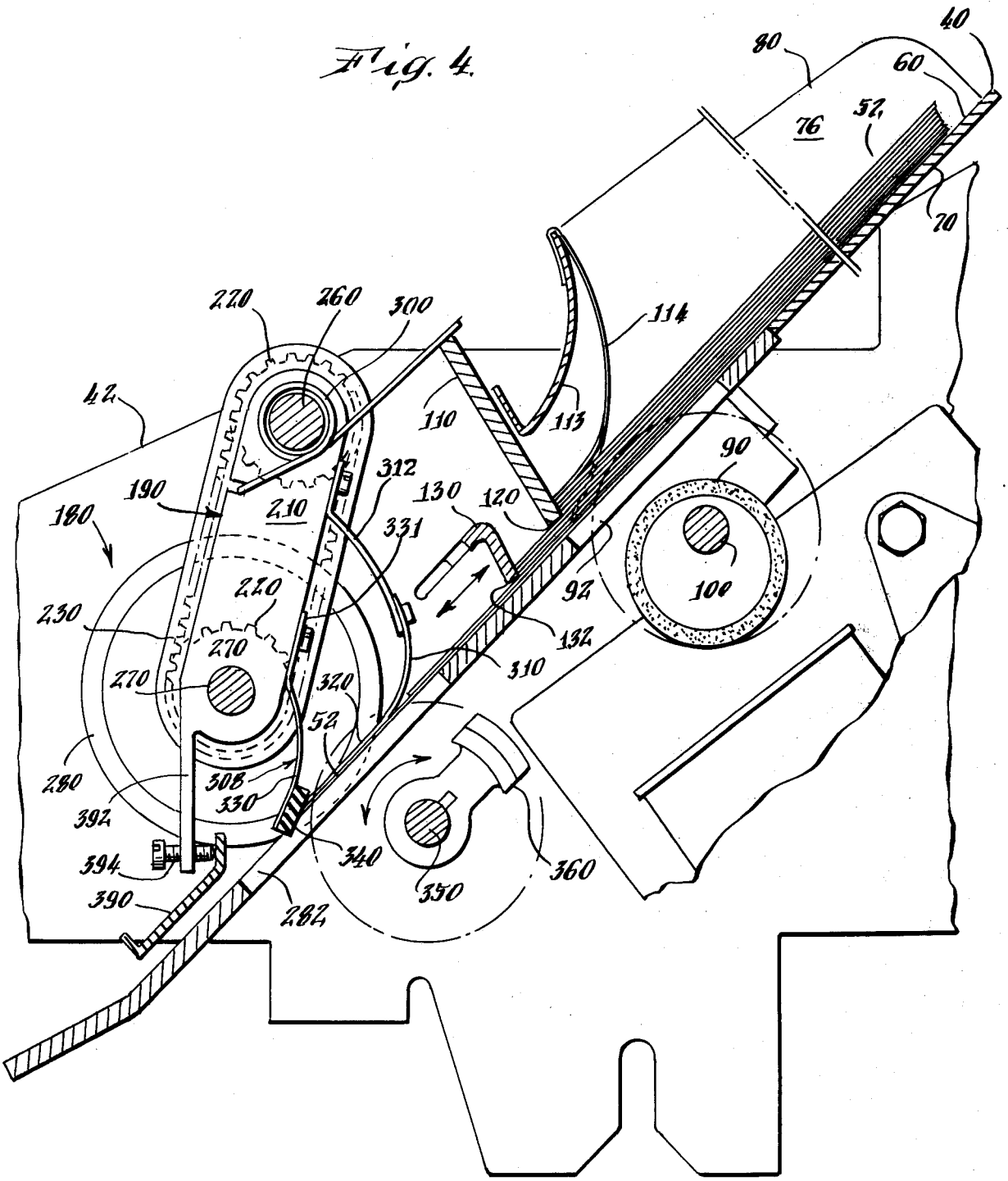
FIG. 4 is a sectional view along the lines 4—4 in FIG. 2.

The document-feeding apparatus of the invention is used, for example, with a facsimile machine 10 (FIG. 1) which includes a main housing 20 which contains facsimile receiving and transmitting apparatus. The housing 20 has a top wall 30, on which is mounted a console 32 which carries operating buttons 34 and a document-holding tray in the form of a flat plate 40 which faces the front of the machine and the user of the machine. The tray 40 is aligned with an opening in the console and disposed at an angle for supporting one or more documents 52 to be fed, one at a time, into the machine through the opening where it is processed by the transmitting apparatus. Tray 40 is suitably secured between left and right side plates 42 and 44 which also provide support for other portions of the apparatus to be described. Tray 40 may be considered to have a long axis which runs parallel to side plates 42 and 44. The angle of tray 40 to top wall 30 may be about 45° or so.

Figure 5:
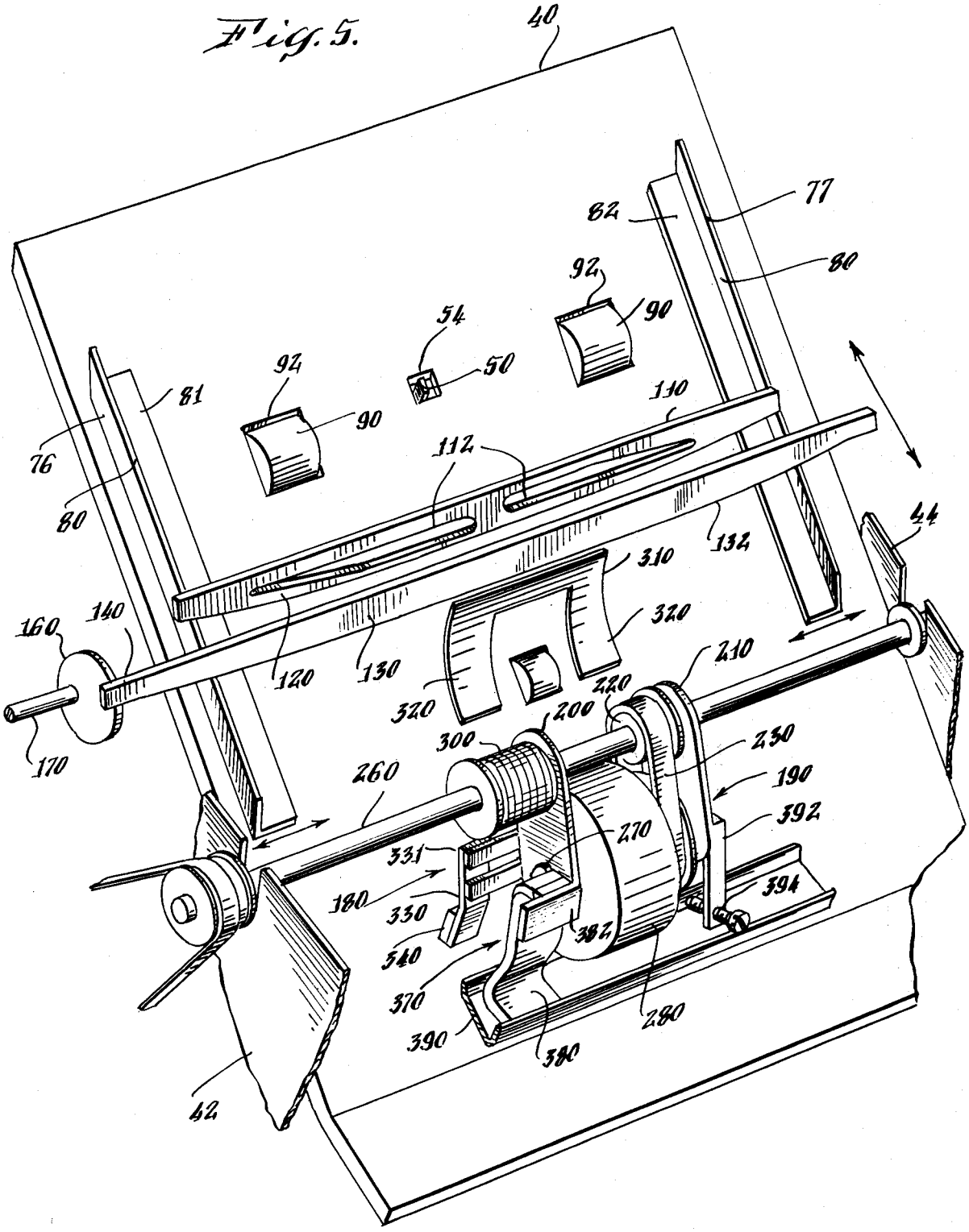
FIG. 5 is a perspective view, partly exploded, of the apparatus of the invention.
Figure 6:
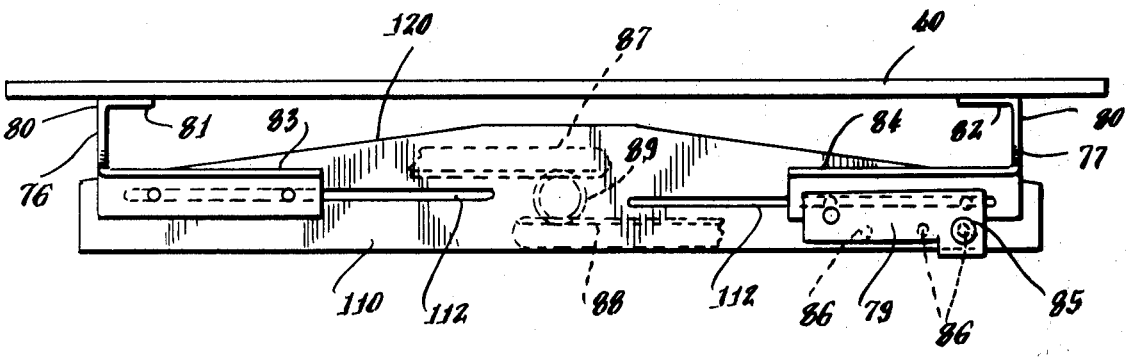
FIG. 6 is a plan view of a portion of the apparatus of FIG. 2.
Figure 7:
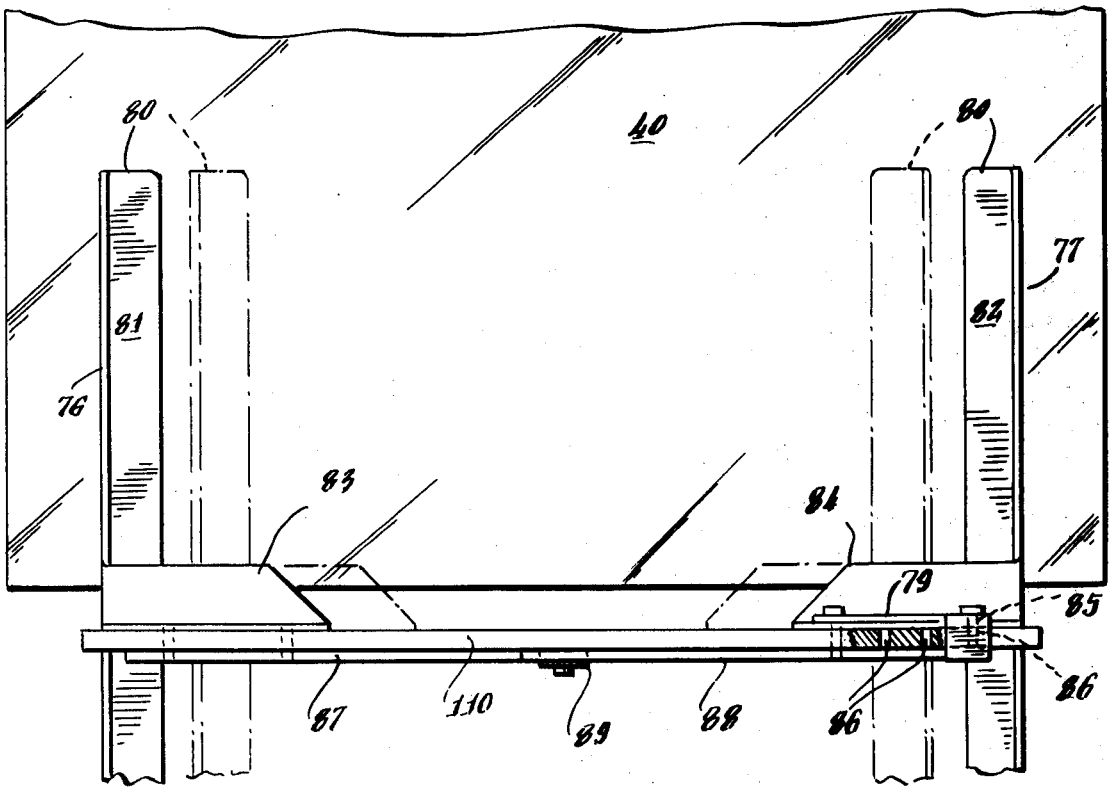
FIG. 7 is a front elevational view of a portion of the apparatus of FIG. 2 illustrating the operation thereof.

An arm 50 of a paper-sensing switch (FIG. 5) extends through an aperture 54 in the tray 40 to sense the presence or absence of documents 52 on the tray. The tray has a front surface 60 and back surface 70 and is adapted to support a stack of documents 52 on its front surface between a pair of spaced-apart, adjustable L-shaped paper guides 80. The guides 80 (FIGS. 2 and 5) have vertical legs 76 and 77 and horizontal legs 81 and 82 which are disposed parallel to the top surface of tray 40 and have a thickness of about 0.040". The edges of the documents on tray 40 rest on the horizontal legs of the guide plates, and are thus elevated slightly above the tray 40. This assists the documents to pass under a pair of baffle plates 110 and 130 to be described below.

The two guide plates 78 and 80 are slidably and adjustably coupled to baffle plate 110, which extends across tray 40, so that the spacing between them can be varied to accommodate documents of different widths.

In one suitable arrangement, the guide plates 78 and 80 are secured to brackets 83 and 84 which are positioned so that they can slide along the top surface of plate 110. One bracket 84 carries spring arm 79 which carries a pin 85 which can be inserted in guide holes 86 in the plate to lock the guides at different spacings. The plate 110 is provided with elongated slots 112, and the brackets 83 and 84 are connected through slots 112 beneath the plate 110 to a plate 87 and to a plate 88 which operate as racks, with the racks being coupled to a pinion 89 disposed between them. With this arrangement, and with spring arm 79 raised to remove pin 85 from plate 110, the racks and their L-shaped guides 78 and 80 can be moved back and forth with respect to each other as desired, and then arm 79 is released to permit pin 85 to lock into plate 110.

The document feeding apparatus of the invention, referring to FIG. 4, also includes a pair of spaced-apart nudger cam rollers 90 which are rotatably mounted on a shaft 100 disposed transverse to the long axis of tray 40 beneath the bottom surface 70 of the tray. The nudger rollers are designed and positioned so that they project slightly through openings 92 in the tray during a portion of their path of travel, and they rotate in a path parallel to the long axis of the tray. The rollers 90 are disposed at about the transverse center line of the paper sheets on the tray, and they have a surface coefficient of friction such that they can urge a stack of documents downhill on the tray. Baffle plate 110, which is a fixed baffle, is provided, above the top surface 60 of tray 40 downhill from the rollers 90 and disposed across the tray, tilted uphill at about 10° off the vertical, and parallel to nudger shaft 100, there being a space of about ⅛ inch between the lower edge 120 of the baffle plate 110 and the tray 40, through which a number of documents, for example twenty-five, can pass from the bottom of the stack of documents supported on the tray. The lower edge 120 of baffle plate 110 has a generally convex shape facing the tray (FIG. 5), and this insures that a document will pass beneath the plate and feed properly, even though its edges may be bent slightly. The lower edge 120 need not be exactly convex, but at least the spacing between it and tray 40 increases as one proceeds from the center of the tray to the left and right sides.

A bracket 113 is secured to the rear surface of plate 110 and carries a Mylar strip 114 which bears against the stack of documents.

A vibrating baffle plate 130 is provided, downhill from the fixed plate 110 and oriented across and transverse to the top surface of the tray, parallel to baffle 110, with a smaller spacing than plate 110, between it and the tray. This spacing is about 1/16 inch. This baffle plate 130 also has a generally convex lower edge 132. The baffle plate 130 extends beyond the edges of the tray, and at least one end 140 thereof is adapted to be engaged by a cam 160 on a shaft 170. The cam 160 is designed so that, when the shaft 170 rotates, it drives the baffle plate 130 in a direction parallel to tray 40 toward and away from baffle plate 110 to provide a vibratory and separating action on a stack of documents which has passed beneath plate 110 and is bearing against the baffle plate 130. The baffle plate 130 is suitably supported to achieve the desired vibratory action. The baffle plate 130 is closer to tray 40 than plate 110 so that a smaller number of documents will pass beneath it than passed beneath baffle plate 110.

Downhill from the vibrating baffle plate 130 is a separator roller assembly 180 which separates documents, one at a time, from the bottom of the stack. The separator roller assembly includes a large-diameter separator roller 280 disposed above tray 40 and a smaller drive roller 360 disposed below tray 40. The assembly 180 includes a bracket 190 comprising left and right plates 200 and 210, between which is positioned separator roller 280 which is secured to and rotatable on a horizontal shaft 270 which is rotatably secured to plates 200 and 210. The plates 200 and 210, themselves, are freely rotatably mounted at their upper ends on an upper horizontal shaft 260. Gears 220 on shafts 260 and 270 and a belt 230 couple together shafts 260 and 270 whereby shaft 270 and roller 280 can be positively driven. The separator roller 280 is positioned so that it projects slightly through an opening 282 (FIG. 4) in tray 40, and its surface lies below the bottom surface of tray 40 by a small amount, about 1/32 inch. The roller 280 is adapted to rotate counter-clockwise, as seen in FIG. 4. A spring 300 is coupled between plate 200 and plate 110 (FIGS. 4 and 5) and is arranged to urge the roller assembly 180 against the tray 40 and against document sheets 52 supported thereon. As can be seen, the roller 280 rotates in a path parallel to the long axis of tray 40.

Behind the plates 200 and 210 is secured a generally U-shaped Mylar strip 310 having legs 320 which are of such length that they bear against the document sheets on the tray 40 and press these sheets against the tray. The Mylar strip is secured to a metal plate 312 which itself is secured to plate 200 and 210. In addition, at its lower end, the plate 200 carries a one-way clutch 308 (FIG. 4) which comprises a metal strip 330 which is secured at its upper end 331 to the plate 200 and extends downwardly and is shaped so that its lower end 332 is close to the documents on tray 40. The rear surface of the metal strip, at its lower end which faces the documents, carries a pad 340 of rubber or the like. The one-way clutch 308 permits document sheets to move downhill, but if, for some reason, a sheet tries to move uphill, it will engage the rubber pad 340 and will flex the spring in the wrong direction and the sheet will be prevented from moving uphill. A second one-way clutch may also be secured to plate 210, if desired.

Behind the separator roller 280 and adjacent to the back surface of the tray 40, is provided the driver roller 36 mounted on a shaft 350, disposed transverse to the long axis of tray 40, and rotatable counter-clockwise, as seen in FIG. 4. Drive roller 360 rotates in a path parallel to the long axis of tray 40 and is designed and positioned to contact the separator roller 280 over a portion of its path of rotation, for example 90°, so that a document sheet is fed only during this portion of the complete path of rotation of the two rollers. The separator roller and drive roller mesh intimately during a feeding operation.

In order to perform the desired operation of feeding a single sheet, in addition to their rotating in the same direction, the surface of drive roller 360 has a coefficient of friction of 2, and the separator roller 280 has a coefficient of friction of 1. This combination of factors permits the feeding of one sheet at a time from the bottom of a stack on tray 40. Roller 360 urges the bottom sheet to feed, and roller 280 urges the other few sheets on the tray to remain in place.

A damper mechanism 370 is provided for preventing the separator roller 280 from generating oscillations due to impact with the drive roller 360. This damper mechanism comprises a flat rubber strip 380 secured at one end to a plate 382, which is secured to bracket 200 or 210. The greater portion of the remainder of the strip 380 is seated in a U-shaped metal plate 390, which is secured between side walls 42 and 44. The rubber strip is of such a length that it is curved and under compression and normally exerts a generally vertical force on the separator roller assembly 180. This prevents the roller assembly from oscillating due to impact between rollers 280 and 360.

An adjustable stop mechanism is also provided including a bracket 392 secured to plate 210 and carrying an adjustable screw 394 which engages a portion of U-shaped plate 390.

After a document is moved by the drive roller 360 out from under the stack of document sheets, it is fed to the scanning and transmitting apparatus located inside housing 20 and not shown.

In operation of the invention, a stack of documents 52 is placed on the document tray 40 in front of, or uphill from, the baffle plate 110. An electric motor (not shown) drives all rollers and shafts simultaneously and moves the baffle 130 back and forth parallel to tray 40. The nudger rollers 90 rotate and intermittently push the documents against the baffle plate 110 which permits a small number of documents, perhaps twenty-five, to move from the bottom of the stack downhill to the vibrating baffle plate 130 which provides a second separating action and permits a smaller number of documents, for example ten, to move downhill toward the nip between the separator roller 280 and the drive roller 360. The separator roller 280 and the drive roller 360 rotate in the same direction, counter-clockwise, as seen in FIG. 4; however, at the surfaces of the tray, the surface of roller 280 is moving uphill and the surface of roller 360 is moving downhill. This relative surface motion of the rollers and their different surface coefficients of friction cause the final separation and feeding of one document from the bottom of the stack.

It is noted that, at the nip between rollers 280 and 360, the drive roller 360 is positioned a small, suitable distance uphill from the separator roller 280 (FIG. 4) so that it strikes the bottom document sheet uphill from the separator roller, and uphill from the lower edge of the document as the feeding operation takes place. Thus, the two rollers cannot tear the paper at the lower edge, as might happen if both rollers met at the edge of the document.

The friction pad 340 acts as a one-way clutch and prevents the backward or uphill movement of documents. The Mylar strip 310 straightens documents and guides them under the friction pad 340. It is noted that one or two documents, if placed on the document support tray 40, will move by gravity and will be stopped by the strip 310 and the separator roller 280 which projects below the top surface of the tray.

What is claimed is:

1. Document-feeding apparatus comprising a tray for supporting a stack of documents for processing, said tray having a top surface and a bottom surface and a long axis, a first roller disposed adjacent to the top surface of said tray, and a second roller disposed adjacent to the bottom surface of said tray, said rollers being mounted for rotation in a plane parallel to said long axis, said rollers being mounted in operative relation with each other and positioned so that, over at least a portion of their paths of rotation, they contact each other through an opening in said tray, the surface of said second roller having a greater coefficient of friction than the surface of said first roller whereby, when said rollers contact each other, said second roller causes the document at the bottom of the stack to feed between the rollers to an operating station, said first roller being part of an assembly which includes support means freely rotatable on a first shaft disposed transverse to said tray, said first roller being coupled to and rotated by said shaft, a generally U-shaped bracket mounted adjacent to said first roller assembly, and a shock absorber comprising a rubber strip securely seated in said U-shaped bracket and having an end secured to said assembly whereby any mechanical shocks suffered by said assembly are absorbed by said rubber strip.

2. The apparatus defined in claim 1 and including a one-way clutch comprising a flexible metallic strip having a first end and a second end, the first end thereof being secured to said assembly and the second end carrying a pad which rests on documents disposed adjacent to said assembly on said tray, said pad and strip permitting documents to be fed by said first and second rollers but preventing documents from moving in a direction opposite to the feeding direction.

3. The apparatus defined in claim 1 and including a pair of L-shaped plates mounted parallel to said tray for supporting the edges of documents disposed on said tray, said L-shaped plates being laterally adjustable so that they can be positioned at different spacings with respect to each other.

4. The apparatus defined in claim 1 wherein said first roller is disposed with its surface positioned slightly beneath the bottom surface of said tray.

5. The apparatus defined in claim 1 and including a first fixed baffle plate disposed adjacent to the upper surface of said tray, and a second vibrating baffle plate disposed adjacent to said top surface of said tray, said second baffle plate being positioned between said first baffle plate and said first roller.

6. The apparatus defined in claim 5 wherein said first and second baffle plates include lower edges which are disposed adjacent to the top surface of said tray, both of said lower edges having a generally convex shape, with the center portions thereof being positioned closer to said tray than the side edge portions.

7. The apparatus defined in claim 5 and including a flexible insulating strip disposed behind said first baffle plate and pressing against documents supported on the top surface of said tray.

8. The apparatus defined in claim 1 and including a flexible insulating strip secured at one end to said assembly and havings its other end resting on documents to press said documents against the top surface of said tray.

9. The apparatus defined in claim 1 and including a pair of rollers disposed beneath said tray at an upper portion thereof remote from said first and second rollers and positioned beneath a stack of documents supported thereon, said rollers extending into said tray through apertures therein for urging said documents downhill.

10. The apparatus defined in claim 1 wherein said first and second rollers cooperate to feed documents, and said second roller is offset slightly from said first roller so that it contacts the bottom document in a stack at a location spaced from its leading edge to prevent tearing of said leading edge.

* * * * *